US007278381B2

(12) United States Patent
Matsutani et al.

(10) Patent No.: US 7,278,381 B2
(45) Date of Patent: Oct. 9, 2007

(54) COOLING STRUCTURE OF CYLINDER BLOCK

(75) Inventors: Takashi Matsutani, Toyota (JP); Takanori Nakada, Toyota (JP); Yoshikazu Shinpo, Nisshin (JP); Takashi Kubota, Obu (JP); Makoto Hatano, Obu (JP)

(73) Assignees: Toyota Jidosha Kabushiki Kaisha, Toyota-shi (JP); Aisan Kogyo Kabushiki Kaisha, Obu-shi (JP)

( * ) Notice: Subject to any disclaimer, the term of this patent is extended or adjusted under 35 U.S.C. 154(b) by 0 days.

(21) Appl. No.: 11/082,876

(22) Filed: Mar. 18, 2005

(65) Prior Publication Data

US 2005/0217615 A1 Oct. 6, 2005

(30) Foreign Application Priority Data

Mar. 31, 2004 (JP) ..... 2004-103660

(51) Int. Cl.
*F02F 1/14* (2006.01)
*F02F 1/36* (2006.01)
*F02B 75/18* (2006.01)

(52) U.S. Cl. ..... 123/41.74; 123/41.79; 123/41.82 R

(58) Field of Classification Search ..... 123/41.72, 123/41.74, 41.79, 41.24, 41.82 R
See application file for complete search history.

(56) References Cited

U.S. PATENT DOCUMENTS

| | | | | |
|---|---|---|---|---|
| 4,782,891 | A | 11/1988 | Cheadle et al. | |
| 5,188,071 | A * | 2/1993 | Han | 123/195 R |
| 6,581,550 | B2 | 6/2003 | Shinpo et al. | |
| 6,883,471 | B1 | 4/2005 | Belter et al. | |

FOREIGN PATENT DOCUMENTS

| | | |
|---|---|---|
| DE | 1 220 203 | 6/1966 |
| DE | 27 56 120 | 6/1979 |
| DE | 37 41 838 A1 | 6/1988 |
| DE | 198 40 379 C2 | 3/2000 |
| DE | 696 10 358 T2 | 4/2001 |
| DE | 696 22 883 T2 | 4/2003 |
| DE | 103 25 753 A1 | 4/2004 |

(Continued)

OTHER PUBLICATIONS

U.S. Office Action mailed Dec. 15, 2005 in U.S. Appl. No. 11/067,655.
German Office Action dated May 26, 2006 with English Translation Thereof.
U.S. Office Action mailed Dec. 19, 2005 in U.S. Appl. No. 11/081,732.
U.S. Office Action mailed Mar. 22, 2006 in U.S. Appl. No. 11/082,870.
German Office Action mailed Jul. 26, 2006 with English Translation Thereof.

*Primary Examiner*—Stephen K. Cronin
*Assistant Examiner*—Hyder Ali
(74) *Attorney, Agent, or Firm*—Kenyon & Kenyon LLP

(57) ABSTRACT

A cooling structure for uniformly cooling a bore wall of a cylinder block using a cooling medium, the bore wall surrounding plural bore regions, includes a water jacket portion which is provided so as to surround an entire outer periphery of the bore wall, and which is supplied with the cooling medium; a water jacket spacer which is inserted in the water jacket portion; a passage through which the cooling medium in a portion of an inter-bore region is transferred to another portion of the inter-bore region, the inter-bore region being positioned in a vicinity of a boundary between the bore regions adjacent to each other; and a flow promotion device which increases a flow rate of the cooling medium flowing in the passage.

6 Claims, 8 Drawing Sheets

FOREIGN PATENT DOCUMENTS

| | | | |
|---|---|---|---|
| DE | 103 25 874 | A1 | 5/2004 |
| EP | 1 167 735 | A2 | 1/2002 |
| JP | A 4-119330 | | 10/1992 |
| JP | Y2 2604041 | | 2/2000 |
| JP | A 2002-30989 | | 1/2002 |
| JP | A 2002-030989 | | 1/2002 |

* cited by examiner

COOLING STRUCTURE OF CYLINDER BLOCK

INCORPORATION BY REFERENCE

The disclosure of Japanese Patent Application No. 2004-103660 filed on Mar. 31, 2004, including the specification, drawings and abstract is incorporated herein by reference in its entirety.

BACKGROUND OF THE INVENTION

1. Field of the Invention

The invention relates to a cooling structure of a cylinder block, and more particularly to a cooling structure of a cylinder block, which makes it possible to uniformly cool the cylinder block.

2. Description of the Related Art

A conventional cooling structure of a cylinder block is disclosed, for example, in Japanese Patent Laid-Open Publication No. 2002-30989.

In the conventional cooling structure of a cylinder block disclosed in the Japanese Patent Laid-Open Publication No. 2002-30989, a temperature of a bore wall is made uniform in a circumferential direction of a bore by inserting a water jacket spacer which is separate from a cylinder block in a water jacket of the cylinder block.

However, even in the aforementioned technology, the temperature of the bore wall cannot be made sufficiently uniform.

Further, even when a drill path is provided in a portion which coolant does not directly contact, and whose temperature becomes high, an inter-bore region which is positioned in the vicinity of a boundary between bore regions adjacent to each other is not sufficiently cooled. This is thought to be because the water jacket spacer obstructs an inlet of the drill path, and therefore a flow rate of the coolant in the drill path is reduced.

SUMMARY OF THE INVENTION

In view of the above, it is an object of the invention to provide a cooling structure of a cylinder block, which makes it possible to uniformly cool the cylinder block.

An aspect of the invention relates to a cooling structure for uniformly cooling a bore wall of a cylinder block using a cooling medium, the bore wall surrounding plural bore regions. The cooling structure of a cylinder includes a water jacket portion which is provided so as to surround an entire outer periphery of the bore wall, and which is supplied with the cooling medium; a water jacket spacer which is inserted in the water jacket portion; a passage through which the cooling medium in a portion of an inter-bore region is transferred to another portion of the inter-bore region, the inter-bore region being positioned in a vicinity of a boundary between the bore regions adjacent to each other; and a flow promotion device which increases a flow rate of the cooling medium flowing in the passage.

Since the cooling structure of a cylinder block that is thus configured includes the flow promotion device which increases the flow rate of the cooling medium flowing in the passage, it is possible to sufficiently cool a portion of the inter-bore region which needs to be cooled.

The flow promotion device may be a cut portion which is provided in the water jacket spacer in a vicinity of an opening of a drill path which serves as the passage. Also, the flow promotion device may be a penetrating hole which is provided in the water jacket spacer in the vicinity of the opening of the drill path.

BRIEF DESCRIPTION OF THE DRAWINGS

The above mentioned and other objects, features, advantages, technical and industrial significance of this invention will be better understood by reading the following detailed description of exemplary embodiments of the invention, when considered in connection with the accompanying drawings, in which.

DETAILED DESCRIPTION OF THE PREFERRED EMBODIMENTS

Figure 1:
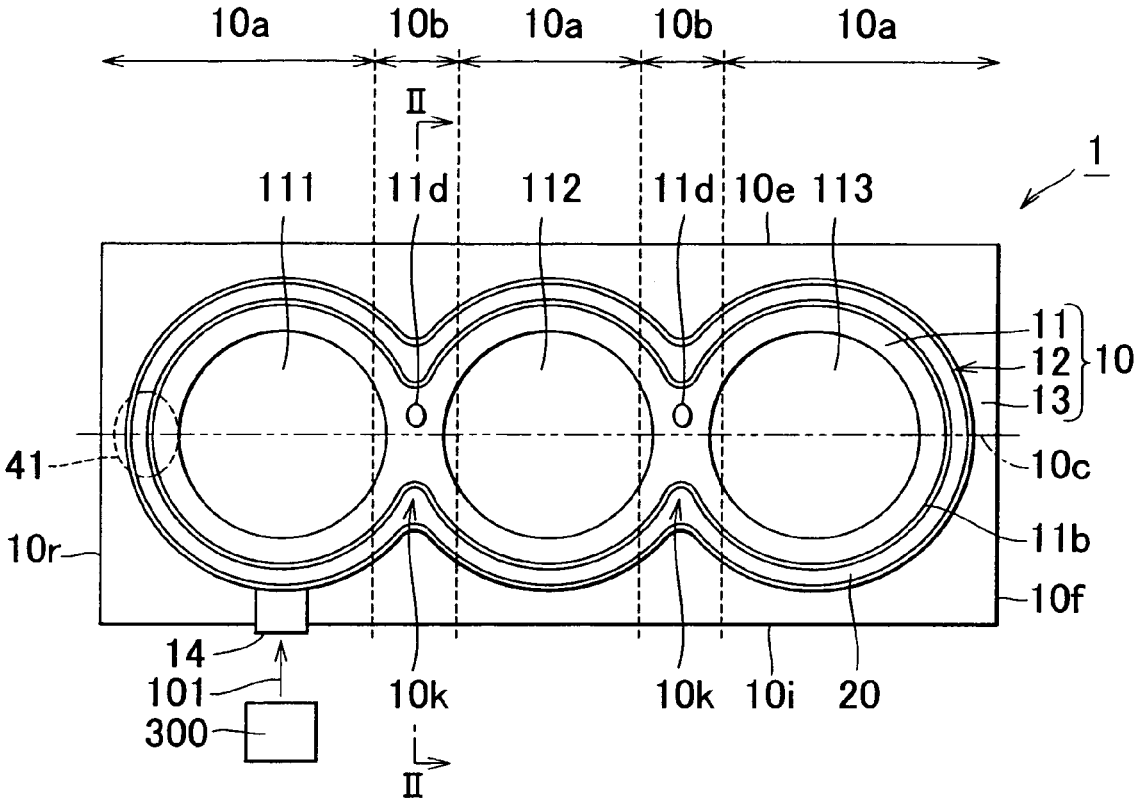
FIG. 1 is a plan view showing a cooling structure of a cylinder block according to a first embodiment of the invention.

In the following description and the accompanying drawings, the present invention will be described in more detail in terms of exemplary embodiments.

In the following embodiments, the same or equivalent portions are denoted by the same reference numerals, and duplicate description thereof will be omitted.

FIG. 1 is a plan view showing a cooling structure of a cylinder block according to a first embodiment of the invention. As shown in FIG. 1, in a cooling structure 1 of a cylinder block according to a first embodiment of the invention, a cylinder block 10 is cooled by coolant that is a cooling medium. The cylinder block 10 includes a cylinder liner assembly 11; a water jacket portion 12 which has a groove shape, and which surrounds the cylinder liner assembly 11; and a cylinder block base portion 13 which surrounds the water jacket portion 12.

The cylinder liner assembly 11 includes three bore regions 111, 112, and 113. The bore regions 111, 112, and 113 are surrounded by iron alloy, and the iron alloy is surrounded by aluminum alloy. The cylinder liner assembly 11 is surrounded by the water jacket portion 12 in which the cooling medium flows. The water jacket portion 12 has a concave shape. Also, the water jacket portion 12 has a shape similar to a shape of the cylinder liner assembly 11 so as to surround the cylinder liner assembly 11. The cylinder block base portion 13 is an engine block main body, and is made of aluminum alloy.

A coolant inlet 14 which is an inlet for the cooling medium is provided in the cylinder block base portion 13. A gasket is provided so as to cover the cylinder block base portion 13. A gasket hole 41 which serves as a passage for the cooling medium is provided in the gasket. An engine head is provided on the gasket. A passage which leads to the gasket hole 41 is provided in the engine head. Since the cooling medium flows through the passage, the engine head can be cooled.

The water jacket spacer 20 is fitted into the water jacket portion 12 such that a predetermined space is provided between the water jacket spacer 20 and a bore wall 11*b* of the cylinder liner assembly 11.

A flow of the coolant in the water jacket portion 12 will be described. The coolant inlet 14 is positioned on an upstream side, and the gasket hole 41 is positioned on a downstream side. The coolant flows between the bore wall 11*b* of the cylinder liner assembly 11 and the water jacket spacer 20 from the upstream side to the downstream side. The coolant flows also between the water jacket spacer 20 and the cylinder block base portion 13.

The coolant makes a U-turn at a front side 10*f* of the cylinder block 10, and the coolant flows from an intake side 10*i* to an exhaust side 10*e*. The coolant flows to the gasket hole 41 at a rear side 10*r*, and the coolant is guided to an engine head side. This is the flow of the coolant in an example of a block preceding U-turn cooling system. An arrow 101 in FIG. 1 indicates the flow of the coolant. The flow of the coolant is not limited to the flow shown in FIG. 1. A system in which the coolant does not make a U-turn, that is, a system in which the coolant is supplied at the rear side 10*r* and the coolant flows from the rear side 10*r* to the front side 10*f*, or a system in which the coolant from the front side 10*f* to the rear side 10*r* may be employed.

The water jacket spacer 20 is positioned such that a predetermined space is provided also between the water jacket spacer 20 and the cylinder block base portion 13. The coolant flows also in this space, and removes heat from the cylinder block base portion 13. The coolant is introduced through the coolant inlet 14, and flows along the bore wall 11*b* surrounding the bore regions 111, 112, and 113. At this time, the coolant removes heat from the bore wall 11*b*. Thus, the temperature of each of the bore regions 111, 112, and 113 can be decreased.

One of inter-bore regions 10*b* is provided in the vicinity of a boundary 10*k* between the bore regions 111 and 112, and the other inter-bore region 10*b* is provided in the vicinity of the boundary 10*k* between the bore regions 112 and 113. Each of the inter-bore regions 10*b* is positioned between other regions 10*a*. In the inter-bore region 10*b*, since a direction of the flow of the coolant is sharply changed, the coolant is likely to stagnate. Accordingly, in order to cool the inter-bore regions 10*b*, drill paths 11*d* are provided. Each of the drill paths 11*d* is provided so as to penetrate the cylinder liner assembly 11 in the inter-bore region 10*b*, and the coolant flows in each drill path 11*d*. Thus, it is possible to remove heat from the cylinder liner assembly 11 in each inter-bore region 10*b*. Each of the drill paths 11*d* is provided so as to cross a center line 10*c* which connects the plural bore regions 111, 112, and 113.

Part of the coolant supplied to the coolant inlet 14 from a water pump 300 in the direction indicated by the arrow 101 flows along the bore wall 11*b*, thereby cooling the bore wall 11*b*. The other part of the coolant flows in the drill path 11*d*, thereby cooling the cylinder liner assembly 11.

Figure 2:
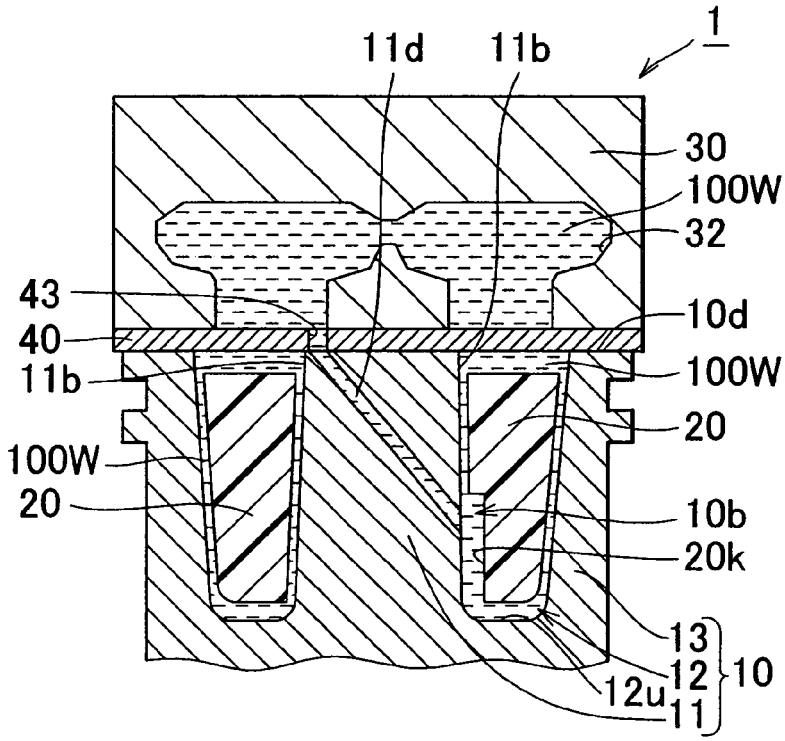
FIG. 2 is a cross sectional view taken along line II—II in FIG. 1.

FIG. 2 is a cross sectional view taken along line II—II in FIG. 1. As shown in FIG. 2, in the cooling structure 1 of a cylinder block according to the first embodiment of the invention, the cylinder block 10 includes the cylinder liner assembly 11 which is provided inside the cylinder block 10; the water jacket portion 12 which is provided so as to surround the cylinder liner assembly 11, and which serves as the cooling medium passage; and the cylinder block base portion 13 which surrounds the water jacket portion 12, and which is opposed to the cylinder liner assembly 11.

The cylinder liner assembly 11 includes the bore wall 11*b*, and the bore wall 11*b* contacts coolant 100W that is the cooling medium.

The water jacket portion 12 is a region provided between the cylinder liner assembly 11 and the cylinder block base portion 13. The water jacket portion 12 serves as the passage for the cooling medium. The water jacket portion 12 includes a bottom portion 12*u*. The cylinder liner assembly 11 is connected to the cylinder block base portion 13 at the bottom portion 12*u*. A width of the water jacket portion 12 is not limited to a specific width. The water jacket portion 12 may be configured to have a substantially constant width. Also, the water jacket portion 12 may have a V-shape. In this case, a portion of the bore wall 11*b* which is opposed to the water jacket portion 12 has a taper surface.

The cylinder block base portion 13 is made of aluminum alloy. The cylinder block base portion 13 is formed by die casting. The material used for forming the cylinder block base portion 13 and the cylinder liner assembly 11 is not limited to a specific material. The cylinder liner assembly 11 and the cylinder block base portion 13 may be made of cast iron, instead of aluminum alloy. The cylinder block base portion 13 serves as an engine block. Various auxiliary machines that need to be provided in an engine are fitted to the cylinder block base portion 13.

A hole (not shown) which serves as an inlet for the coolant is provided in the cylinder block base portion 13. The coolant 100W is introduced to the hole which serves as the inlet from the water pump. As the cooling medium, various fluids such as long-life coolant and oil can be used, instead of the coolant 100W.

The water jacket portion 12 is exposed at a deck surface 10*d* which is an upper surface of the cylinder block 10. That is, the cylinder block 10 is an open deck type cylinder block. A gasket 40 and an engine head 11 are provided on the deck surface 10*d*. The gasket 40 seals the water jacket portion 12 so as to prevent the coolant 100W from flowing to the outside of the water jacket portion 12.

The water jacket spacer 20 is inserted in the water jacket portion 12. The water jacket spacer 20 has a shape similar to a shape of the water jacket portion 12. Also, the water jacket spacer 20 is formed so as to surround the cylinder liner assembly 11. The material used for forming the water jacket spacer 20 is not limited to a specific material. As the material used for forming the water jacket spacer 20, it is possible to use various materials, such as aluminum, cast iron, nonmetallic materials, inorganic materials, and resin.

The drill paths 11*d* which are penetrating holes are provided in the cylinder liner assembly 11. Each of the drill paths 11*d* extends from the bore wall 11*b* to the deck surface 10*d*, and is continuous with a gasket hole 43. The gasket hole 43 is continuous with a head passage 32.

Each drill path 11*d* is formed by processing the cylinder liner assembly 11 using a drill. The drill path 11*d* may be formed by other processing methods, instead of the drill processing. Further, a portion for forming the drill path 11*d* may be provided in a mold in the case where the cylinder block 10 is formed by die casting. That is, any processing method may be employed for forming each drill path 11*d*, as long as the drill path 11*d* becomes a hole which connects the bore wall 11*b* to the other region.

Accordingly, the drill path 11*d* may connect portions of the bore wall 11*b* which are opposed to each other. In FIG. 2, the drill path 11*d* has a straight line shape. However, the shape of the drill path 11*d* is not limited to this shape. The drill path 11*d* has a curved shape. In the drill path 11*d*, the coolant 100W flows mainly from a lower side to an upper side. That is, the coolant 100W flows from the bore wall 11*b* to the deck surface 10*d* side. As this flow becomes larger, the inter-bore region 10*b* is cooled to a larger extent. Accordingly, in order to actively cool the inter-bore region 10*b*, the configuration needs to be such that this flow from the bore wall 11*b* to the deck surface 10*d* side is not obstructed. According to the invention, a cut portion 20*k* which is a concave portion is provided in the water jacket spacer 20.

That is, the cut portion 20*k* which is the concave portion is provided in the water jacket spacer 20 at a portion which is opposed to an inlet of the drill path 11*d* through which the coolant flows into the drill path 11*d*. Therefore, the inlet of the drill path 11*d* is not obstructed, and the coolant flows in the drill path 11*d* at a sufficient flow rate.

As shown in FIG. 1 and FIG. 2, the cooling structure 1 of a cylinder block according to the invention includes the water jacket portion 12 which is provided so as to surround an entire outer periphery of the bore wall 11*b* surrounding the plural bore regions 111, 112, and 113; and the water jacket spacer 20 which is inserted in the water jacket portion 12. The temperature of the bore wall 11*b* is made uniform by supplying the coolant 100W which is the cooling medium to the water jacket portion 12. The cylinder block 10 includes the inter-bore regions 10*b* one of which is positioned in the vicinity of the boundary 10*k* between the bore regions 111 and 112, and the other of which is positioned in the vicinity of the boundary 10*k* between the bore regions 112 and 113. The cooling structure 1 further includes the drill paths 11*d*. Each of the drill paths 11*d* serves as a passage through which the cooling medium in a portion of the inter-bore region 10*b* is transferred to another portion of the inter-bore region 10*b*. Also, the cut portions 20*k* are provided in the cylinder block 10. Each of the cut portions 20*k* serves as flow promotion means for increasing the flow rate of the cooling medium flowing in the drill path 11*d*.

Figure 3:
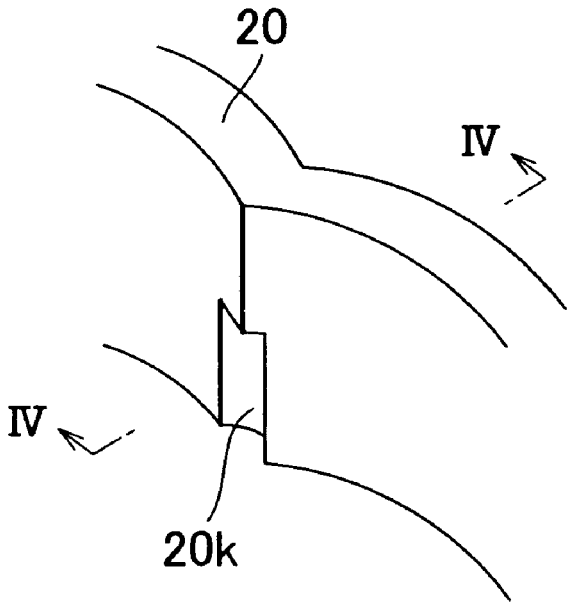
FIG. 3 is a partial perspective view showing a water jacket spacer shown in FIG. 1 and FIG. 2.

FIG. 3 is a partial perspective view showing the water jacket spacer shown in FIG. 1 and FIG. 2. As shown in FIG. 2, the cut portion 20*k* is provided in an inner peripheral surface side of the water jacket spacer 20. The cut portion 20*k* is formed by cutting a portion which protrudes to an innermost position, that is, a ridge portion of the inner peripheral surface of the water jacket spacer 20. Since part of the water jacket spacer 20 is cut off, the flow of the coolant can be promoted at this portion. In FIG. 2, the cut portion 20*k* is provided only in a lower region of the water jacket spacer 20. However, the position at which the cut portion 20*k* is provided is not limited to this position. The cut portion 20*k* may be provided so as to extend from the upper portion to the lower portion of the water jacket spacer 20. That is, the cut portion 20*k* may be provided so as to extend from the bottom portion 12*u* to vicinity of the deck surface 10*d* in FIG. 2.

Figure 4:
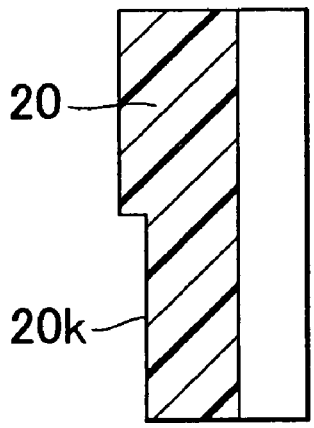
FIG. 4 is a cross sectional view taken along line IV—IV in FIG. 3.

FIG. 4 is a cross sectional view taken along line IV—IV in FIG. 3. As shown in FIG. 4, the cut portion 20*k* has a rectangular shape. The cut portion 20*k* is formed by cutting a substantially rectangular region from the water jacket spacer 20. The method of forming the cut portion 20*k* is not limited to a specific method. For example, in the case where the water jacket spacer 20 is formed by injection molding, plastic material may be poured into a mold having the cut portion 20*k* so that the cut portion 20*k* is formed. Also, the water jacket spacer 20 may be configured so as to have a rectangular cross section, and then machining may be performed on a portion of the water jacket spacer 20 so as to form the cut portion 20*k*. Also, the shape of the cut portion 20*k* is not limited to the rectangular shape, and the cut portion 20*k* may have a curved surface shape.

In the cooling structure 1 of a cylinder block that is thus configured according to the first embodiment of the invention, the cut portion 20*k* is provided in the water jacket spacer 20 so that the flow of the coolant 100W in the drill path 11*d* is not obstructed. Since the cut portion 20*k* is provided, a large space is provided in the vicinity of the inlet of the drill path 11*d*. The coolant 100W actively flows into the drill path 11*d* through the space. Therefore, the flow of the coolant 100W in the drill path 11*d* can be promoted, and heat can be removed from the coolant 100W in the inter-bore region 10*b*. As a result, the inter-bore region 10*b* can be sufficiently cooled. Accordingly, it is possible to provide the cooling structure 1 of a cylinder block, which makes it possible to uniformly cool the cylinder block.

Figure 5:
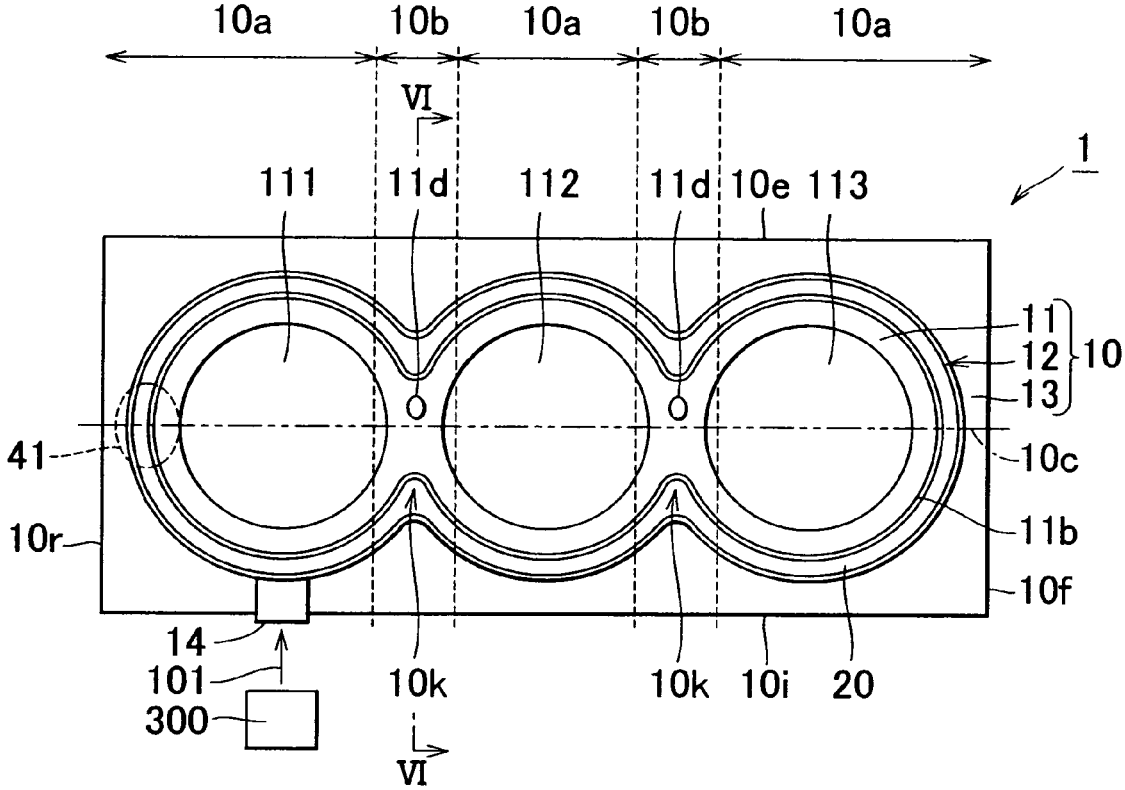
FIG. 5 is a plan view showing a cooling structure of a cylinder block according to a second embodiment of the invention.
Figure 6:
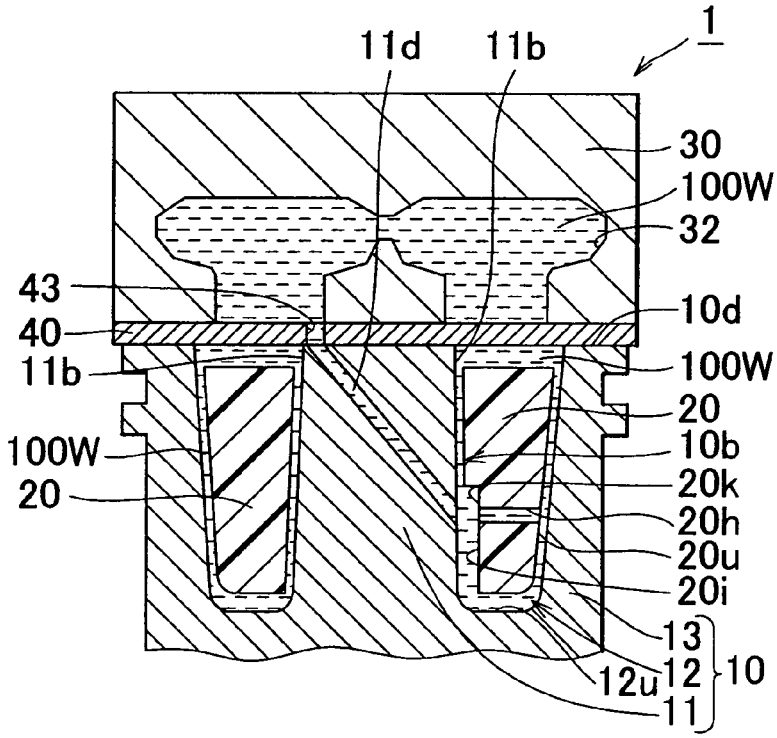
FIG. 6 is a cross sectional view taken along line VI—VI in FIG. 5.

FIG. 5 is a plan view showing a cooling structure of a cylinder block according to a second embodiment of the invention. FIG. 6 is a cross sectional view taken along line VI—VI in FIG. 5. As shown in FIG. 5 and FIG. 6, in the cooling structure 1 of a cylinder block according to the second embodiment of the invention, a penetrating hole 20*h* is formed in the water jacket spacer 20. The penetrating hole 20*h* extends from an inner surface to an outer surface 20*u* of the water jacket spacer 20, and is opposed to the inlet of the drill path 11*d*.

That is, in the second embodiment of the invention, the passage is the drill path 11*d*, and the flow promotion means is the penetrating hole which is formed in the water jacket spacer 20 in the vicinity of the opening of the drill path 11*d*. Since the penetrating hole 20*h* is provided, it is possible to promote the inflow of the coolant at the inlet of the drill path 11*d*, that is, at the opening of the drill path 11*d* which is provided in the bore wall 11*b*. When the coolant 100W flows into the drill path 11*d* from the water jacket portion 12, pressure of the coolant in the vicinity of the opening is reduced. However, since the penetrating hole 20*h* is provided as shown in FIG. 6, it is possible to actively supply the coolant 100W to the drill path 11*d* from the region between the water jacket spacer 20 and the cylinder block base portion 13.

Figure 7:
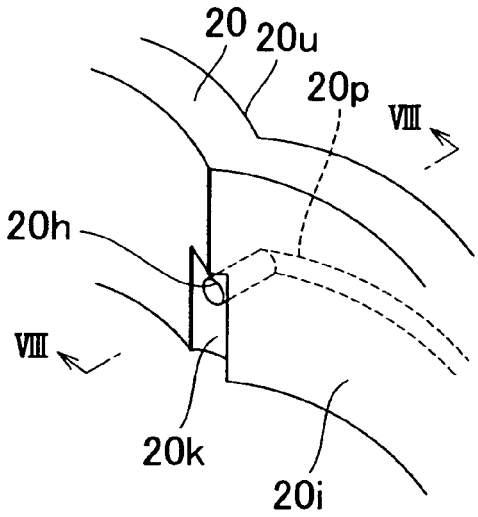
FIG. 7 is a partial perspective view showing a water jacket spacer shown in FIG. 5 and FIG. 6.
Figure 8:
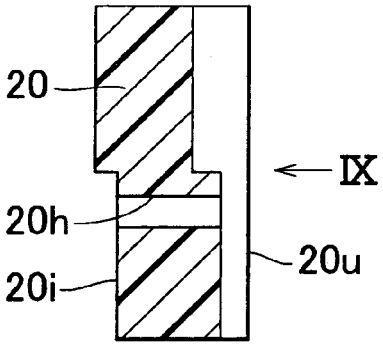
FIG. 8 is a cross sectional view taken along line VIII—VIII in FIG. 7.
Figure 9:
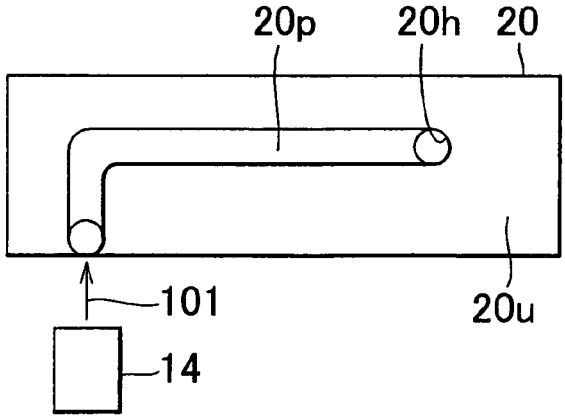
FIG. 9 is a lateral view showing the water jacket spacer seen in a direction indicated by an arrow IX in FIG. 8.

FIG. 7 is a partial perspective view showing the water jacket spacer shown in FIG. 5 and FIG. 6. FIG. 8 is a cross sectional view taken along line VIII—VIII in FIG. 7. FIG. 9 is a lateral view showing the water jacket spacer seen in a direction indicated by an arrow IX in FIG. 8. As shown in FIG. 7 to FIG. 9, the water jacket spacer 20 has such a shape as to surround plural cylindrical regions, and the cut portion 20*k* is formed in an inner peripheral surface 20*i*. The cut portion 20*k* is formed by cutting the ridge portion of the water jacket spacer 20, which protrudes to the innermost position. The penetrating hole 20*h* is provided at an end portion of the cut portion 20*k*.

Since the penetrating hole 20*h* is provided, the flow rate of the coolant in the drill path is increased, and cooling efficiency is improved. A coolant passage 20*p* is connected to the penetrating hole 20*h*. The coolant passage 20*p* is connected to the coolant inlet 14 as shown in FIG. 9. The coolant passage 20*p* which is a groove is provided on the outer surface 20*u* of the water jacket spacer 20. The coolant passage 20*p* connects the penetrating hole 20*h* to the coolant inlet 14 through which the coolant is supplied to the cylinder block 10.

Thus, the cold coolant supplied through the coolant inlet 14 flows through the coolant passage 20*p* provided on the outer surface 20*u*, and reaches the penetrating hole 20*h*. The cold coolant can be supplied directly to the drill path 11*d* through the penetrating hole 20*h*. As shown in FIG. 9, the coolant passage 20*p* has an L shape. However, the shape of the coolant passage 20*p* is not limited to this shape. The coolant passage 20*p* may have a straight line shape. Further, the coolant passage 20*p* may have a curved shape. That is, the shape of the coolant passage 20*p* is not limited to a specific shape, as long as the coolant passage 20*p* connects the coolant inlet 14 to the penetrating hole 20*h*.

Various methods of forming the coolant passage 20*p* may be employed. For example, the coolant passage 20*p* may be formed by machining. Also, in the case where the water jacket spacer 20 is formed by injection molding or the like, a portion for forming the coolant passage 20*p* may be provided in a mold, and plastic material may be poured into the mold so that the coolant passage 20*p* is formed.

The depth of the coolant passage 20*p* is not limited to a specific depth. The coolant passage 20*p* may be provided only in a shallow portion of the outer surface 20*u*. Also, the coolant passage 20*p* may have such a depth as to substantially penetrate the water jacket spacer 20.

The cooling structure 1 of a cylinder block that is thus configured according to the second embodiment of the invention produces the same effects as the effects of the cooling structure 1 of a cylinder block according to the first embodiment of the invention.

Figure 10:
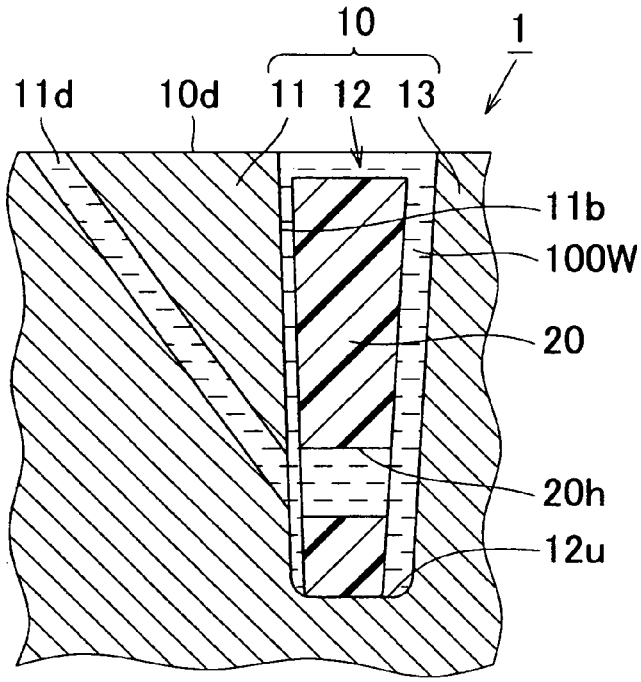
FIG. 10 is a cross sectional view showing a cooling structure of a cylinder block according to a third embodiment of the invention.

FIG. 10 is a cross sectional view showing a cooling structure of a cylinder block according to a third embodiment of the invention. As shown in FIG. 10, the water jacket spacer 20 in the cooling structure 1 of a cylinder block according to the third embodiment of the invention is different from the water jacket spacer 20 according to the second embodiment in that the cut portion is not provided. Though the cut portion is not provided, the penetrating hole 20*h* which serves as the flow promotion means is provided so as to be opposed to the opening of the drill path 11*d*.

In FIG. 10, a predetermined space is provided between the water jacket spacer 20 and the bore wall 11*b*. The space may be minimized. In order to decrease the space, for example, a leaf spring that is force applying means may be pressed into the space between the water jacket spacer 20 and the cylinder block base portion 13. By pressing the force applying means into the space, the water jacket spacer 20 is pressed toward the bore wall 11*b* side. Thus, it is possible to make the water jacket spacer 20 closely contact the bore wall 11*b*.

In FIG. 10, the penetrating hole 20*h* is configured so as to extend in a horizontal direction. However, the configuration of the penetrating hole 20*h* is not limited to this configuration. The penetrating hole 20*h* may be configured to be downward sloping like the drill path 11*d*. Also, the penetrating hole 20*h* may be configured to be upward sloping. In the third embodiment, the penetrating hole 20*h* has a substantially constant internal diameter. However, the internal diameter is not limited to a specific constant value. The internal diameter of the penetrating hole 20*h* may be increased in a direction from the drill path 11*d* to the cylinder block base portion 13. Also, the internal diameter of the penetrating hole 20*h* may be decreased in the direction from the drill path 11*d* to the cylinder block base portion 13.

Since the penetrating hole 20*h* is provided in the water jacket spacer 20 at the portion opposed to the inlet of the drill path 11*d*, it is possible to prevent the inlet of the drill path 11*d* from being obstructed.

The cooling structure 1 of a cylinder block that is thus configured according to the third embodiment of the invention also produces the same effects as those of the cooling structure 1 of a cylinder block according to the first embodiment of the invention.

Figure 11:
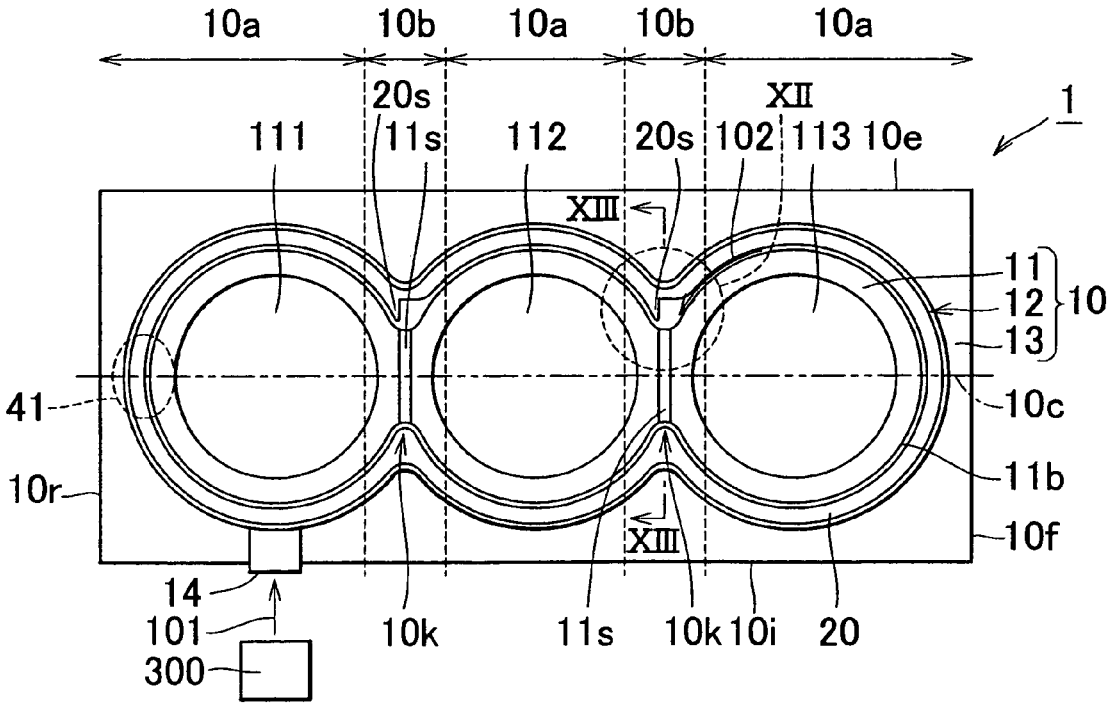
FIG. 11 is a plan view showing a cooling structure of a cylinder block according to a fourth embodiment of the invention.
Figure 12:
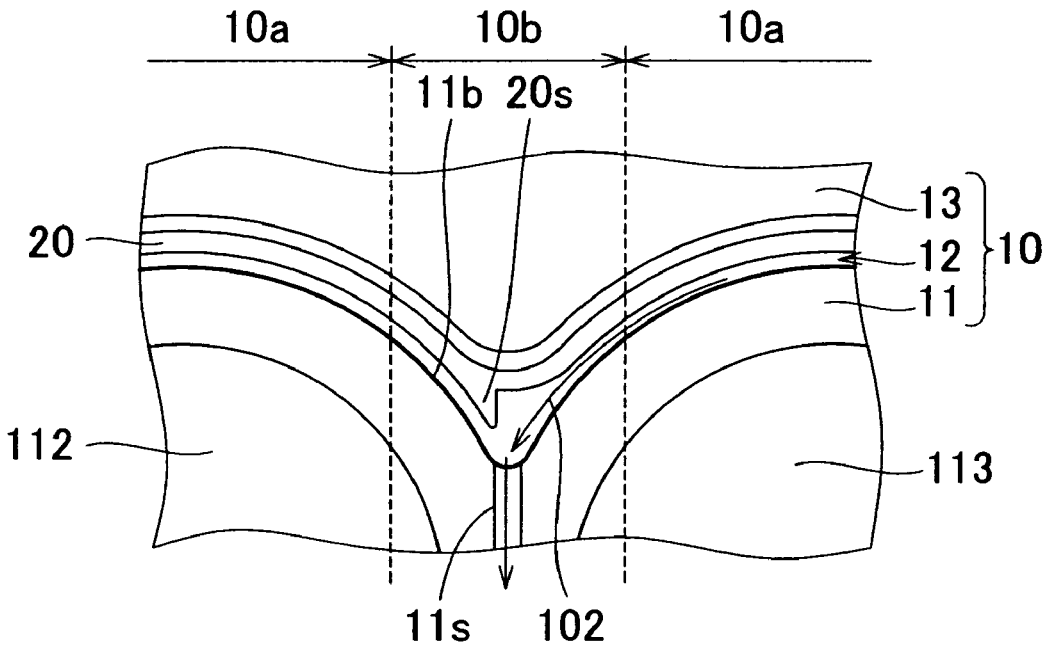
FIG. 12 is a plan view showing an enlarged portion indicated by a dotted circle XII in FIG. 11.
Figure 13:
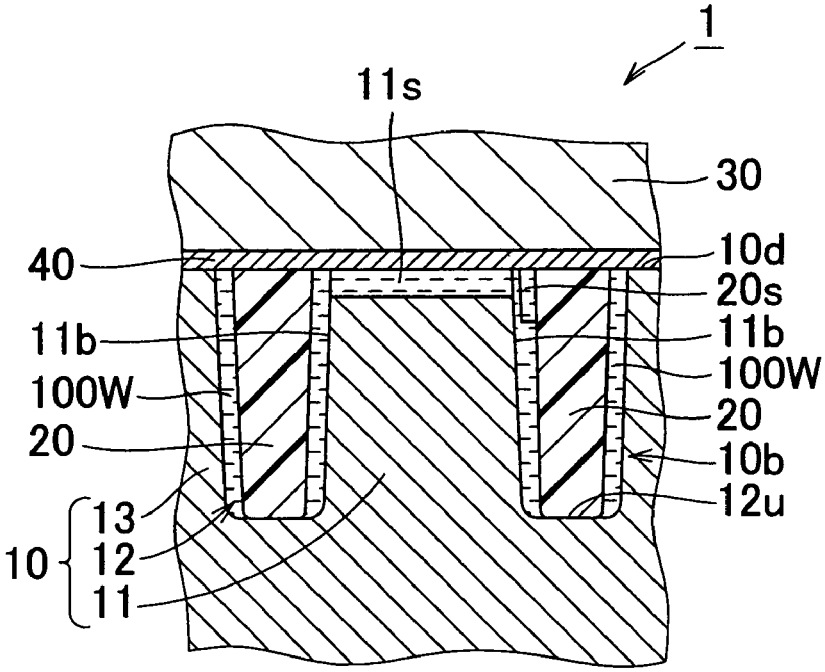
FIG. 13 is a cross sectional view taken along line XIII—XIII in FIG. 11.

FIG. 11 is a plan view showing a cooling structure of a cylinder block according to a fourth embodiment of the invention. FIG. 12 is a plan view showing an enlarged portion indicated by a dotted circle XII in FIG. 11. FIG. 13 is a cross sectional view taken along line XIII—XIII in FIG. 11. As shown in FIG. 11 to FIG. 13, in the cooling structure 1 of a cylinder block according to the fourth embodiment of the invention, a slit 11*s* is provided in the cylinder liner assembly 11. A protrusion portion 20*s* for guiding the coolant to the slit 11*s* is provided integrally with the water jacket spacer 20.

The slit 11*s* is formed so as to penetrate the cylinder liner assembly 11 and to cross the center line 10*c*. Since the slit 11*s* penetrates the inter-bore region 10*b*, the inter-bore region 10*b* can be sufficiently cooled if the coolant is supplied to the slit 11*s* at a sufficient flow rate. However, a difference in pressure between both ends of the slit 11*s* is small. Particularly when the coolant flows in a horizontal direction, the difference in the pressure between both ends of the slit 11*s* is small. More specifically, in the case where the coolant is introduced at the rear side 10*r* of the cylinder block 10, the flow of the introduced coolant is divided into two streams so as to cool the bore wall 11*b*, and then the coolant is discharged at the front side 10*f*, or in the case where the coolant is introduced at the front side 10*f*, the introduced coolant cools the bore wall 11*b*, and then the coolant is discharged at the rear side 10*f*, the pressure at the inlet of the slit 11*s* and the pressure at the outlet of the slit 11*s* become almost the same. Therefore, the inter-bore region 10*b* may not be sufficiently cooled depending on the slit 11*s*.

Also, in the case where the coolant is introduced through the coolant inlet 14, and the coolant is discharged through the gasket hole 41 as shown in FIG. 11, the difference in the pressure between the upstream side and the downstream side of the slit 11*s* is equivalent to pressure loss in the coolant passage. Therefore, the difference in the pressure between the upstream side and the downstream side of the slit 11*s* may become insufficient, and the inter-bore region 10*b* may not be sufficiently cooled.

According to the invention, the protrusion portion 20*s* is provided integrally with the water jacket spacer 20. Since the protrusion portion 20*s* is provided, the pressure of the coolant in the vicinity of the protrusion portion 20*s* is increased, which makes it possible to actively guide the coolant into the slit 11*s*. Thus, the inter-bore region 10*b* can be sufficiently cooled. That is, the flow promotion means is the protrusion portion 20*s* that is provided integrally with the water jacket spacer 20. The slit 11*s* is provided as the passage through which the cooling medium in a portion of the inter-bore region 10*b* is transferred to another portion of the inter-bore region 10*b*.

The cooling structure of a cylinder block that is thus configured according to the fourth embodiment produces the same effects as the effects of the cooling structure of a cylinder block according to the first embodiment.

Figure 14:
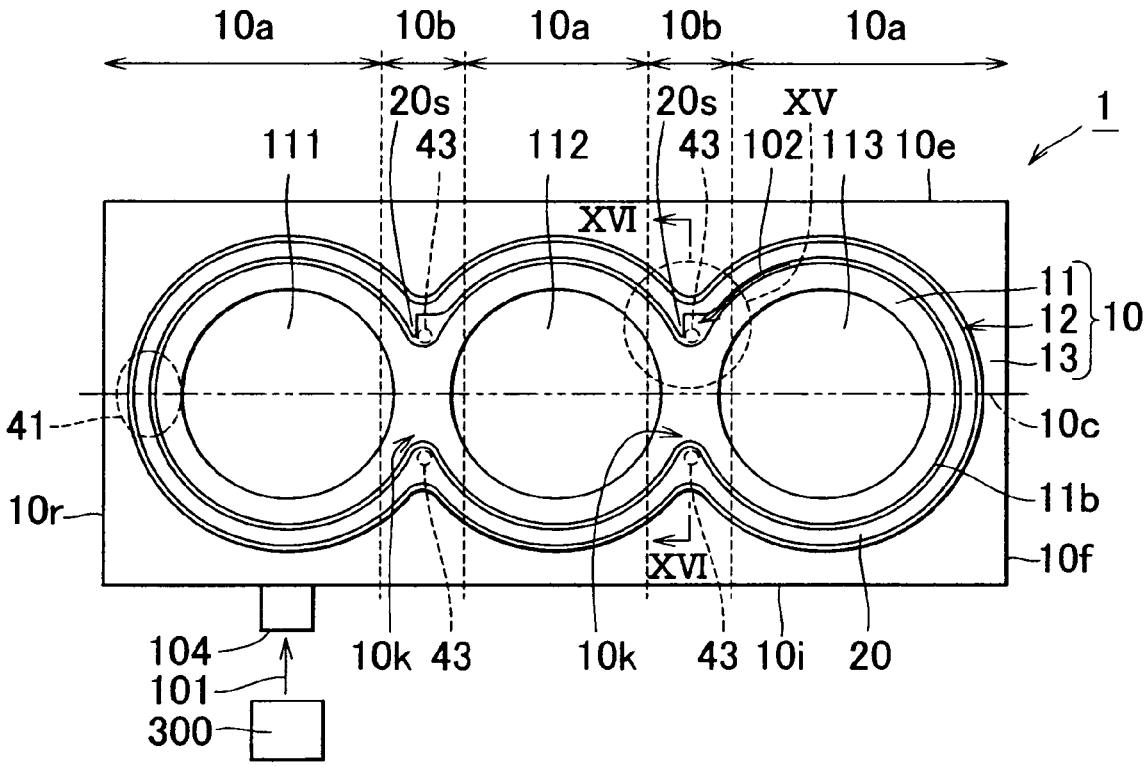
FIG. 14 is a plan view showing a cooling structure of a cylinder block according to a fifth embodiment of the invention.
Figure 15:
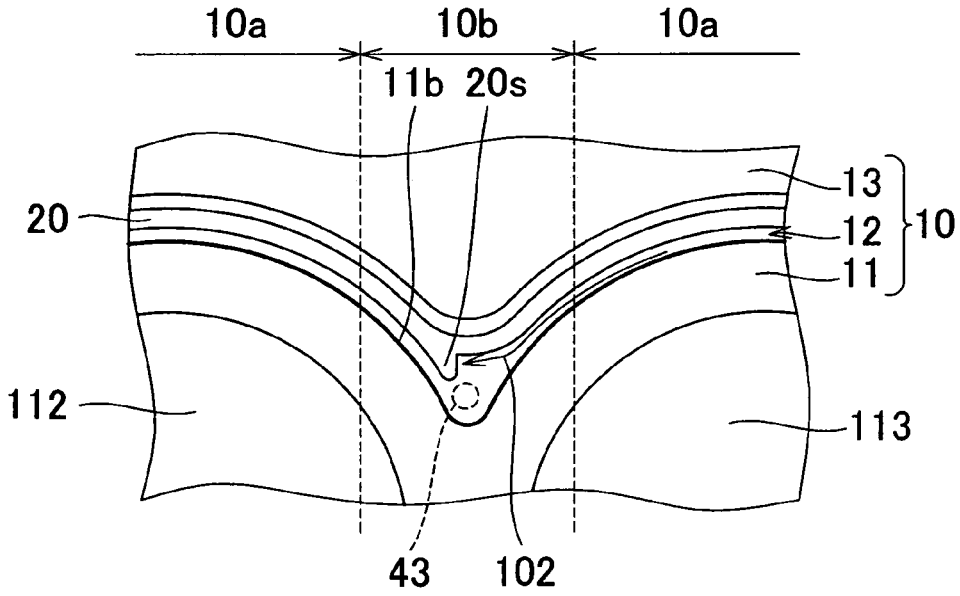
FIG. 15 is plan view showing an enlarged portion indicated by a dotted circle XV in FIG. 14.
Figure 16:
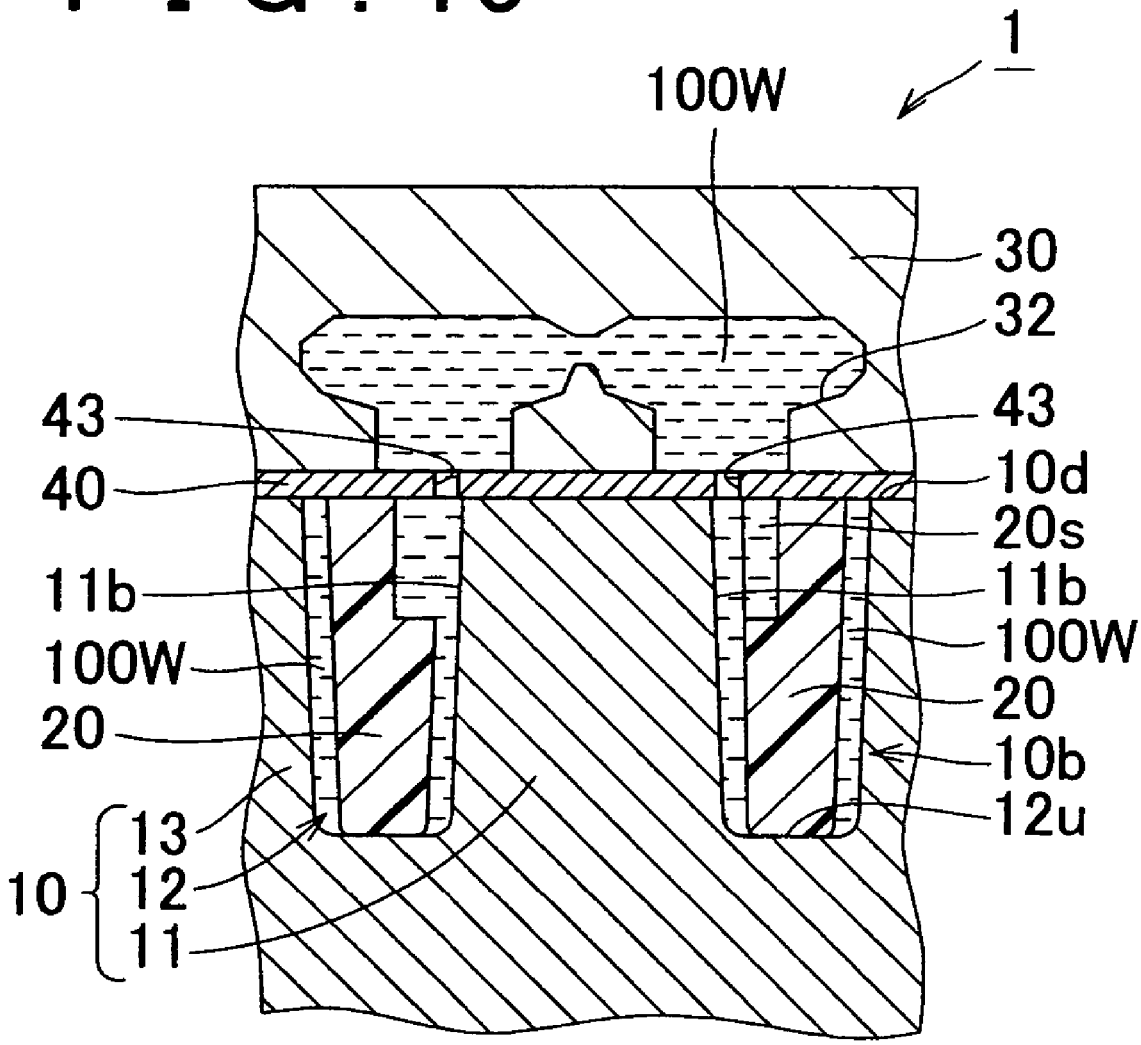
FIG. 16 is a cross sectional view taken along line XVI—XVI in FIG. 14.

FIG. 14 is a plan view showing a cooling structure of a cylinder block according to a fifth embodiment of the invention. FIG. 15 is a plan view showing an enlarged portion indicated by a dotted circle XV in FIG. 14. FIG. 16 is a cross sectional view taken along line XVI—XVI in FIG. 14. As shown in FIG. 14 to FIG. 16, in the cooling structure 1 of a cylinder block according to the fifth embodiment of the invention, the protrusion portion 20*s* is provided integrally with the water jacket spacer 20, and the gasket hole 43 is provided in the vicinity of the protrusion portion 20*s*. The gasket hole 43 is continuous with the head passage 32. The gasket hole 43 serves as the passage between the head passage 32 and the water jacket portion 12. Since the gasket hole 43 is provided in the inter-bore region 10*b* as a head gasket hole, the gasket hole 43 serves as the passage through which the coolant in a portion of the inter-bore region 10*b* is transferred to another portion. The gasket hole 43 has a circular shape in FIG. 14 and FIG. 15. However, the shape of the gasket hole 43 is not limited to the circular shape. The gasket hole 43 may have a polygonal shape. The gasket hole 43 penetrates the gasket 40, and guides the coolant 100W in the head passage 32 which serves as the passage for the coolant in the engine head to the water jacket portion 12. Also, the gasket hole 43 guides the coolant 100W in the water jacket portion 12 to the head passage 32.

Since the protrusion portion 20*s* is provided integrally with the water jacket spacer 20, the pressure of the coolant 100W in the vicinity of the gasket hole 43 is increased. Therefore, the flow rate of the coolant flowing to the head passage 32 through the gasket hole 43 is increased. Accordingly, the flow of the coolant in the inter-bore region 10*b* can be promoted, and the inter-bore region 10*b* can be actively cooled.

The cooling structure 1 of a cylinder block that is thus configured according to the fifth embodiment of the invention produces the same effects as the effects of the cooling structure of a cylinder block according to the first embodiment.

Although the embodiments of the invention have been described, various modifications can be made to the embodiments. In the embodiments, one cylinder block 10 includes the three bore regions. However, the number of the bore regions included in one cylinder block 10 is not limited to three. One cylinder block 10 may include two bore regions, or may include four or more bore regions.

The invention can be applied to a gasoline engine and a diesel engine. Also, the invention can be applied to various engines such as an in-line engine, a V-type engine, a W-type engine, and a horizontal opposed engine.

The invention can be applied to a field of a cooling structure of a cylinder block of an internal combustion engine.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less ore only a single element, are also within the spirit and scope of the invention.

What is claimed is:

1. A cooling structure for uniformly cooling a bore wall of a cylinder block using a cooling medium, the bore wall surrounding plural bore regions, comprising:

a water jacket portion which is provided so as to surround an entire outer periphery of the bore wall, and which is supplied with the cooling medium;

a water jacket spacer which is inserted in the water jacket portion;

a passage through which the cooling medium in a portion of an inter-bore region is transferred to another portion of the inter-bore region, the inter-bore region being positioned in a vicinity of a boundary between the bore regions adjacent to each other; and a flow promotion device which increases a flow rate of the cooling medium flowing in the passage, wherein the passage is a drill path, and the flow promotion device is a cut portion which is provided in the water jacket spacer in a vicinity of an opening of the drill path.

2. A cooling structure for uniformly cooling a bore wall of a cylinder block using a cooling medium, the bore wall surrounding plural bore regions, comprising:

a water jacket portion which is provided so as to surround an entire outer periphery of the bore wall, and which is supplied with the cooling medium;

a water jacket spacer which is inserted in the water jacket portion;

a passage through which the cooling medium in a portion of an inter-bore region is transferred to another portion of the inter-bore region, the inter-bore region being positioned in a vicinity of a boundary between the bore regions adjacent to each other; and a flow promotion device which increases a flow rate of the cooling medium flowing in the passage, wherein the passage is a drill path, and the flow promotion device is a penetrating hole which is provided in the water jacket spacer in a vicinity of an opening of the drill path.

3. The cooling structure of a cylinder block according to claim 2, wherein a groove is provided on an outer surface of the water jacket spacer, and the groove connects the penetrating hole to a hole through which the cooling medium is supplied to the cylinder block.

4. A cooling structure for uniformly cooling a bore wall of a cylinder block using a cooling medium, the bore wall surrounding plural bore regions, comprising:

a water jacket portion which is provided so as to surround an entire outer periphery of the bore wall, and which is supplied with the cooling medium;

a water jacket spacer which is inserted in the water jacket portion;

a passage through which the cooling medium in a portion of an inter-bore region is transferred to another portion of the inter-bore region, the inter-bore region being positioned in a vicinity of a boundary between the bore regions adjacent to each other; and a flow promotion device which increases a flow rate of the cooling medium flowing in the passage, wherein the flow promotion device is a protrusion portion which is provided integrally with the water jacket spacer.

5. The cooling structure of a cylinder block according to claim 4, wherein the passage is a slit which connects a portion of the water jacket portion in the inter-bore region to another portion of the water jacket portion in the inter-bore region.

6. The cooling structure of a cylinder block according to claim 4, wherein the passage is a gasket hole which is provided in an upper portion of the cylinder block, and the flow promotion device is a protrusion portion which is provided integrally with the water jacket spacer.

* * * * *